US008668306B2

(12) United States Patent
Eguchi et al.

(10) Patent No.: US 8,668,306 B2
(45) Date of Patent: Mar. 11, 2014

(54) LIQUID EJECTING HEAD AND LIQUID EJECTING APPARATUS

(71) Applicant: Seiko Epson Corporation, Tokyo (JP)

(72) Inventors: Masayuki Eguchi, Shiojiri (JP); Shigeki Suzuki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/771,564

(22) Filed: Feb. 20, 2013

(65) Prior Publication Data

US 2013/0215192 A1 Aug. 22, 2013

(30) Foreign Application Priority Data

Feb. 21, 2012 (JP) ..... 2012-034742

(51) Int. Cl.
*B41J 2/165* (2006.01)

(52) U.S. Cl.
USPC ..... 347/33; 347/22; 347/67

(58) Field of Classification Search
USPC ..... 347/22, 29, 32–33, 44, 47, 65, 67, 71, 347/85, 86
See application file for complete search history.

(56) References Cited

U.S. PATENT DOCUMENTS 8,197,048 B2 * 6/2012 Yamanaka et al. ..... 347/94

FOREIGN PATENT DOCUMENTS

JP 2009-34830 2/2009

* cited by examiner

*Primary Examiner* — Thinh Nguyen
(74) *Attorney, Agent, or Firm* — Workman Nydegger

(57) ABSTRACT

A liquid ejecting head including: a head unit having a nozzle forming surface on which a plurality of rows of nozzles ejecting a liquid are arranged and of which the nozzle forming surface is wiped by a wiping member along an arrangement direction of the nozzle rows; and a fixing member, wherein the fixing member has a fixing plate section on which an exposure opening section exposing the nozzles of the nozzle forming surface is formed and of which an upper surface is joined to the nozzle forming surface as a fixing reference surface in a state where the nozzle is exposed into the exposure opening section, and a cutout section, which opens the exposure opening section in the wiping direction and exposes an edge portion of the nozzle forming surface, is formed downstream of the wiping member in the wiping direction in the exposure opening section.

6 Claims, 4 Drawing Sheets

LIQUID EJECTING HEAD AND LIQUID EJECTING APPARATUS

BACKGROUND

1. Technical Field

The present invention relates to a liquid ejecting head such as an ink jet type recording head and a liquid ejecting apparatus including the liquid ejecting head, and in particular, to a liquid ejecting head including a head unit which has a nozzle forming surface on which a plurality of nozzle rows are provided and a fixing member which fixes the head unit, and a liquid ejecting apparatus.

2. Related Art

As a liquid ejecting head which ejects a liquid as liquid droplets from a nozzle, for example, there is an ink jet type recording head which is used in an image recording apparatus such as an ink jet type recording apparatus. Recently, since the ink jet type recording head has features in which a very small amount of the liquid can be accurately landed on a predetermined position, the recording head has been also applied to all types of manufacturing apparatus. For example, the ink jet type recording head may be applied to a display manufacturing apparatus which manufactures a color filter of a liquid crystal display, an electrode forming apparatus which forms an electrode of an organic Electro Luminescence (EL) display or an Field Emission Display (FED), and an biochip manufacturing apparatus which manufactures a biochip (a bio-chemical element). Then, in the recording head for the image recording apparatus, a liquid ink is ejected and solution of each color material of Red (R), Green (G) and Blue (B) is ejected from a color material ejecting head for the display manufacturing apparatus. In addition, a liquid electrode material is ejected from an electrode material ejecting head for the electrode forming apparatus, and solution of the bioorganic matter is ejected from a bioorganic matter ejecting head for the chip manufacturing apparatus.

The liquid ejecting head described above includes a head unit which has a nozzle forming surface on which a plurality of nozzle rows are provided and a fixing member which fixes the head unit, and the nozzle of the nozzle forming surface is exposed from an exposure opening section opened to the fixing member. In addition, there is a liquid ejecting head in which the nozzle forming surface is wiped by a wiping member so that a drawback such as a blocked nozzle due to a solidified liquid which remains on the nozzle forming surface can be prevented. Furthermore, the liquid ejecting head of which the nozzle forming surface is able to be wiped has been proposed in which a cavity section is formed between the nozzle forming surface and the fixing member, and the liquid which is wiped by the wiping member is discharged to the outside through the cavity section (for example, see, JP-A-2009-34830).

In the meantime, in the liquid ejecting head disclosed in JP-A-2009-34830 described above, when the liquid having a higher viscosity than that of the related art is used, there is a concern that the liquid may remain inside the cavity section even though the liquid attached on the nozzle forming surface is wiped by the wiping member. Then, when the liquid remaining inside the cavity section is solidified and then clogs the cavity section, the liquid, which is wiped by the wiping member after clogging occurs, is not able to enter the cavity section and accumulates on the nozzle forming surface. Thus, there is a concern that defective blowing of the liquid (the liquid droplet) which is ejected from the nozzle or the clogging (impossibility of ejection of the liquid droplet) of the nozzle may occur.

SUMMARY

An advantage of some aspects of the invention is to provide a liquid ejecting head and a liquid ejecting apparatus in which a liquid is easily wiped from a nozzle forming surface even though the viscosity of the liquid is higher than that of the related art.

According to an aspect of the invention, there is provided a liquid ejecting head including: a head unit having a nozzle forming surface on which a plurality of rows of nozzles ejecting a liquid are arranged and of which the nozzle forming surface is wiped by a wiping member along an arrangement direction of the nozzle rows; and a fixing member fixing the head unit, wherein the fixing member has a fixing plate section on which an exposure opening section exposing the nozzles of the nozzle forming surface is formed and of which an upper surface is joined to the nozzle forming surface as a fixing reference surface in a state where the nozzle is exposed into the exposure opening section, and wherein a cutout section, which opens the exposure opening section in the wiping direction and exposes an edge portion of the nozzle forming surface, is formed downstream of the wiping member in the wiping direction in the exposure opening section.

In the aspect, the liquid is easily wiped from the nozzle forming surface even though the viscosity of the liquid is higher than that of the related art. Accordingly, a drawback such as an accumulated ink on the nozzle forming surface can be suppressed.

Further, in the configuration described above, it is preferable that the fixing member be formed by a metal plate material and the cutout section be formed by cutting the fixing plate section positioned downstream in the wiping direction.

In the aspect, the fixing member formed with the cutout section can be easily produced.

Further, in the configuration described above, it is preferable that portions of the fixing member which are positioned at both sides of the cutout section be bent to the opposite side in the liquid ejecting direction and the bent portions be connected to each other by a connection section.

In the aspect, even though the cutout section is provided, it is difficult to deform the fixing member and the head unit can be fixed to a position as designed.

Further, according to another aspect of the invention, there is provided a liquid ejecting apparatus including the liquid ejecting head and the wiping member according to any configuration described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. In addition, in the embodiments described below, a variety of limitations is given as preferred specific examples, however, the range of the invention is not limited to the embodiments unless there is no description with specific intention of limiting the invention. Furthermore, in the following description, an ink jet type printer 1 (a type of liquid ejecting apparatus of the invention) is exemplified as the liquid ejecting apparatus of the invention.

Figure 1:
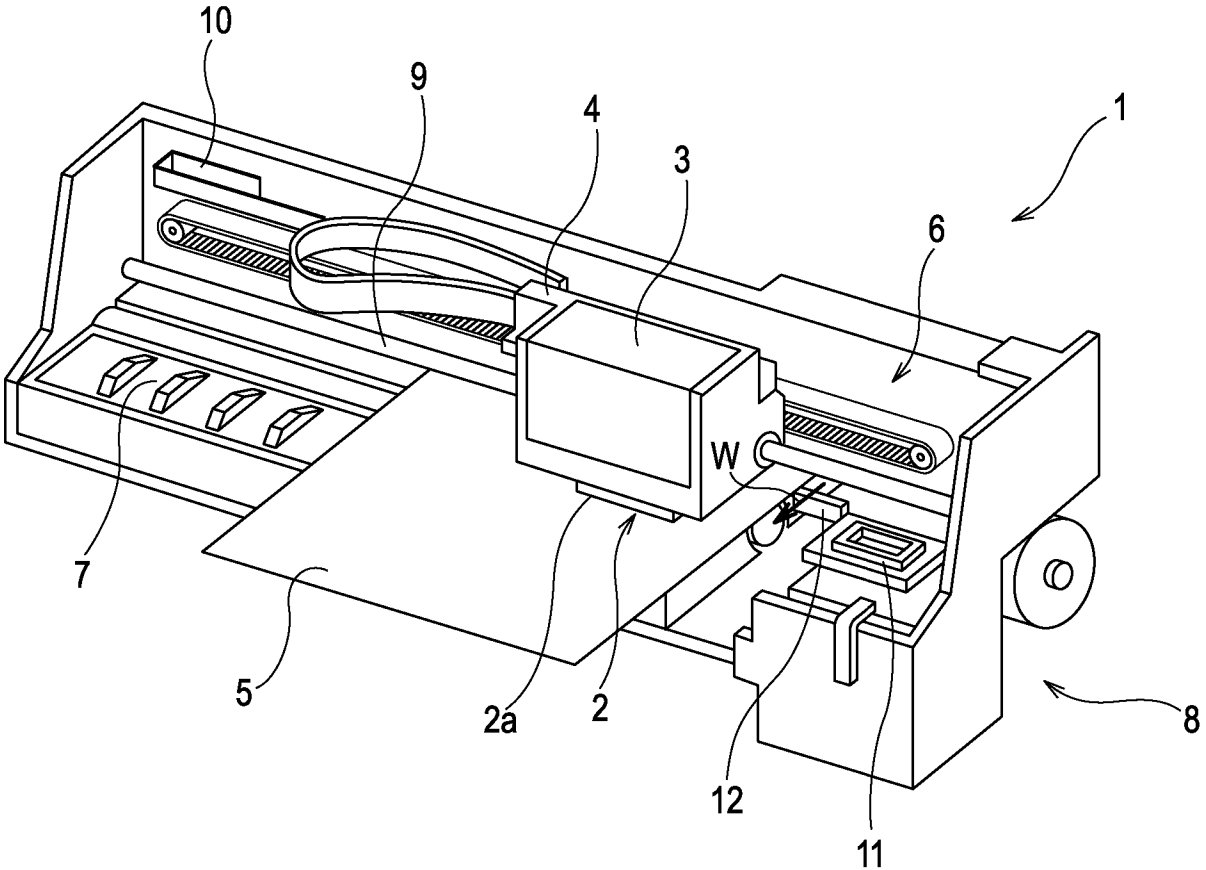
FIG. 1 is a perspective view explaining a configuration of a printer.

FIG. 1 is a perspective view illustrating a configuration of the printer 1. The printer 1 includes a carriage 4 on which an ink jet type recording head 2 (hereinafter, referred to as a recording head) that is a type of liquid ejecting head is mounted and an ink cartridge 3 that is a type of a liquid storage member in which a liquid is stored inside thereof is detachably mounted. The back portion of the carriage 4 includes a carriage moving mechanism 6 which causes the carriage 4 to reciprocate in the width direction of recording paper 5 (a type of recording medium and landing target), that is, in the main scanning direction. In addition, a platen 7 is provided with a gap below the recording head 2 during a recording operation. The recording paper 5 is transported on the platen 7 in the sub-scanning direction orthogonal to the main scanning direction by a transportation mechanism 8 provided in the rear of the printer 1.

The carriage 4 is pivotally mounted on a guide rod 9 which is installed in the main scanning direction. The carriage 4 moves in the main scanning direction along the guide rod 9 with the operation of the carriage moving mechanism 6. The position of the carriage 4 in the main scanning direction is detected by a linear encoder 10 that is a type of a position information detecting unit, and a detection signal thereof, in other words, an encoder pulse (a type of position information) is transmitted to a control section of the printer 1.

In addition, a home position that is a reference point of the scanning of the carriage 4 is set in a region further outside than the recording region inside the moving range of the carriage 4. A sealing member (a capping member) 11 which seals a nozzle forming surface (a surface ejecting the ink towards the recording paper 5 side) 2*a* of the recording head 2 described below and a wiping member (a wiper member) 12 which moves in a wiping direction (a direction illustrated with an arrow W in FIGS. 1 and 8) that is a direction along the sub-scanning direction and wipes the nozzle forming surface 2*a* are disposed on the home position. Then, the printer 1 carries out so-called a bi-directional recording which records characters, images and the like on the recording paper 5 in the bi-direction when the carriage 4 moves forward from the home position to an end portion of the opposite side and when the carriage 4 moves backward from the end portion of the opposite side to the home position.

In addition, the sealing member 11 is a tray-shaped member opened to the upper surface side facing the nozzle forming surface 2*a* of the recording head 2 and is produced by, for example, an elastic material such as elastomer or rubber. Then, the sealing member 11 is configured so as to move forward and backward with respect to the nozzle forming surface 2*a* of the recording head 2 positioned on the home position. Furthermore, the inner space of the sealing member 11 communicates with a suction unit such as a suction pump (not illustrated) and is configured so as to have a negative pressure by the operation of the suction unit in a state of being capped (a state where the nozzle forming surface 2*a* is sealed). In addition, the wiping member 12 extends along the main scanning direction and is an erected plate-shaped member of which the upper end portion is able to come into contact with the nozzle forming surface 2*a*. The wiping member 12 is produced by, for example, the elastic material such as elastomer or rubber. Then, the wiping member 12 is configured such that the wiping member 12 can move in the wiping direction W and wipe the nozzle forming surface 2*a* in a raised state where the upper end portion thereof comes into contact with the nozzle forming surface 2*a*, and stops in a state of being lowered during non-operation.

Next, the recording head 2 will be described.

Figure 2:
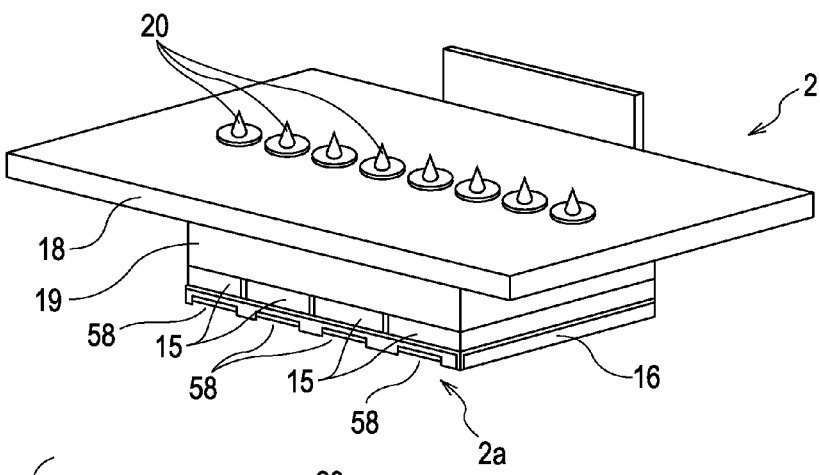
FIG. 2 is a perspective view of a recording head.
Figure 3:
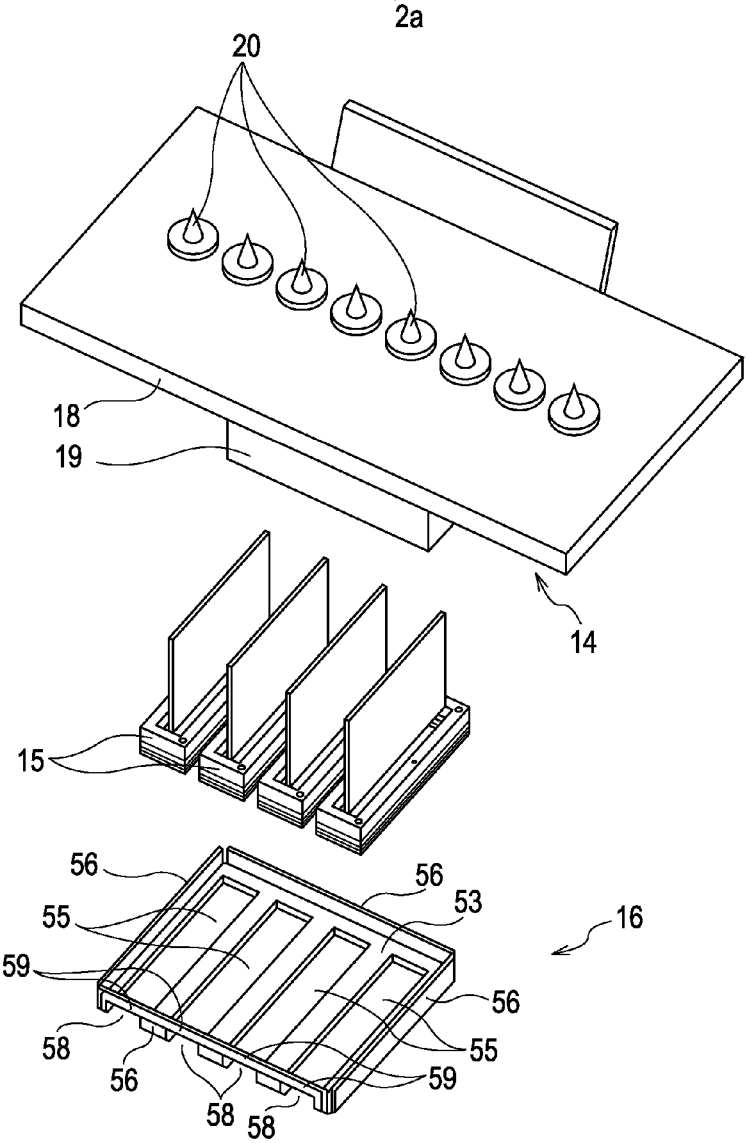
FIG. 3 is an exploded perspective view of the recording head.
Figure 4:
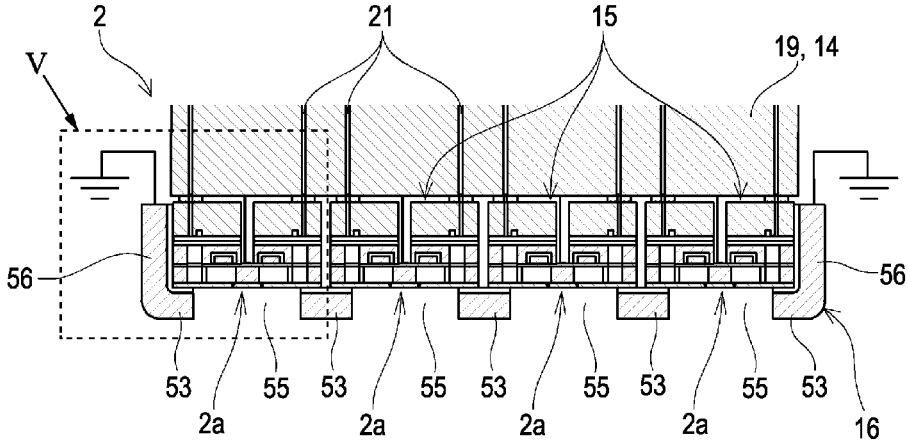
FIG. 4 is a cross-sectional view of the recording head.
Figure 5:
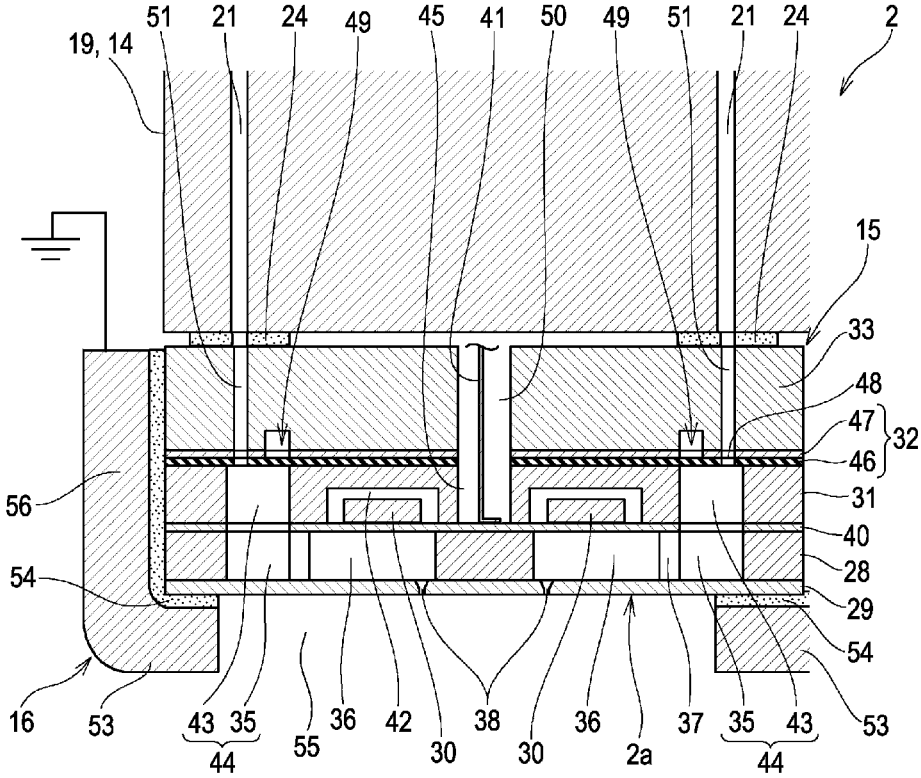
FIG. 5 is an enlarged view of a region in FIG. 4.

FIG. 2 is a perspective view of the recording head 2 of the embodiment, FIG. 3 is an exploded perspective view of the recording head 2 and FIG. 4 is a cross-sectional view of the recording head 2. In addition, FIG. 5 is an enlarged view of a region V in FIG. 4. The recording head 2 in the embodiment is configured of a holder 14, a head unit 15 and a fixing member 16. In addition, a plurality (four in the embodiment) of head units 15 are arranged having gaps along the main scanning direction in the recording head 2.

The holder 14 is configured of a cartridge mounting section 18 on which the ink cartridge 3 is mounted and a head connection section 19 to which the head unit 15 is connected below the cartridge mounting section 18. A plurality of liquid introduction needles 20 are protruded upwards (to the ink cartridge 3 side) on the cartridge mounting section 18. In addition, as illustrated in FIG. 4 and the like, the inside of the holder 14 has a liquid introduction flow path 21 which opens from the liquid introduction needle 20 to the lower surface of the head connection section 19 through the inside of the cartridge mounting section 18. Then, when the ink cartridge 3 is mounted on the recording head 2, the liquid introduction needle 20 is inserted into the ink cartridge 3. Accordingly, the ink from the ink cartridge 3 is introduced into the head unit 15 side through the liquid introduction flow path 21. In addition, the head unit 15 is joined to the lower end of the head connection section 19 by adhesive 24.

Next, the head unit 15 will be described.

As illustrated in FIG. 5, the head unit 15 includes a flow path substrate 28, a nozzle plate 29, a piezoelectric element 30, a protection substrate 31, a compliance substrate 32 and a head case 33.

The flow path substrate 28 is formed of a single crystalline silicon substrate that is long along the sub-scanning direction and two elongated communication sections 35 are formed along the longitudinal direction thereof. In a state where a plurality of pressure chambers 36 are arranged along the sub-scanning direction (in other words, an arrangement direction of rows of nozzles 38 described below), total of two rows of the pressure chambers 36 are formed for each of the communication sections 35 in the region pinched between the communication sections 35. Each of pressure chambers 36 communicates with the communication section 35 via an ink supply path 37 formed with a width that is narrower than that of the pressure chamber 36.

The nozzle plate 29 is fixed to the lower surface (a surface opposite to the piezoelectric element 30) of the flow path substrate 28 using adhesive, a heat welding film or the like. The nozzle plate 29 is formed of a stainless steel (SUS), a single crystalline silicon or the like. A plurality of the nozzles 38, which communicate with a side opposite to the ink supply path 37 of each of the pressure chambers 36, pierce through the nozzle plate 29. The nozzles 38 configure nozzle rows which are arranged along the sub-scanning direction and the wiping direction W, for example, with a pitch of 360 dpi. In addition, the lower surface of the nozzle plate 29 faces the recording paper 5 as the nozzle forming surface 2*a*. In addition, the nozzle forming surface 2*a* is wiped by the wiping member 12 which moves along the nozzle row direction.

An elastic film 40 is laminated on the upper surface (a surface opposite to the nozzle plate 29) of the flow path substrate 28. Two rows of the piezoelectric elements 30 in which, for example, a lower electrode film, a piezoelectric body layer and an upper electrode film are sequentially laminated are arranged on the elastic film 40 in a state where the piezoelectric element 30 faces each of pressure chambers 36. One end of a lead electrode (not illustrated) which is conductive to the upper electrode film is connected to the end portion of one side (the center side) of the piezoelectric element 30. The other end of the lead electrode extends in the center portion side of the head unit 15 on an insulating film and is electrically connected to one end of a flexible cable 41. In addition, the other end of the flexible cable 41 is connected to a control section (not illustrated).

In addition, the protection substrate 31 is joined on the elastic film 40 and has a piezoelectric element holding space 42 which is a space large enough not to inhibit displacement thereof in a region facing the piezoelectric element 30. Two elongated reservoir sections 43, which pass through the elastic film in the thickness direction in positions opposite to a communication section 35, are provided in the protection substrate 31. In addition, an arrangement space 45 capable of connecting the flexible cable 41 and the lead electrode is provided in the center portion thereof. In addition, the reservoir sections 43 communicate with each of communication sections 35 and configure a reservoir (a common liquid chamber) 44 which supplies the ink to the pressure chamber 36.

The compliance substrate 32 is a substrate on which a flexible sealing film 46 and a fixing substrate 47 formed of a hard material such as metal are laminated, and is joined to the upper side (an opposite side to the flow path substrate 28) of the protection substrate 31. An ink introduction port 48, which introduces the ink to the reservoir 44, is formed in the compliance substrate 32 to pass through the compliance substrate in the thickness direction. In addition, a region other than the ink introduction port 48, in the regions facing the reservoir 44 of the compliance substrate 32 is a sealing section 49 which is formed of only the sealing film 46 and where the fixing substrate 47 is removed. Accordingly, the reservoir 44 is sealed by the sealing section 49 having flexibility and then a compliance is obtained.

The head case 33 is a hollow box-shaped member which is joined to the upper side (an opposite side to the protection substrate 31) of the compliance substrate 32. An insertion space 50 which communicates with the arrangement space 45 of the protection substrate 31, and a case flow path 51 are formed inside the head case 33 by being passed through in the height direction thereof. The flexible cable 41 passes through the inside of the insertion space 50. The case flow path 51 is a flow path to supply the ink from the holder 14 side to the reservoir 44 and the upper end thereof communicates with the liquid introduction flow path 21, and the lower end communicates with the ink introduction port 48. In addition, the adhesive 24 fills around a communication portion between the liquid introduction flow path 21 and the case flow path 51. Accordingly, the communication portion between the liquid introduction flow path 21 and the case flow path 51 is sealed. In addition, a portion facing the sealing section 49 in the lower surface of the head case 33 includes a sealing space which is large enough not to inhibit flexible deformation of the sealing film 46.

The head unit 15 configured described above introduces the ink from the ink cartridge 3 into the case flow path 51 through the liquid introduction flow path 21. The ink introduced into the case flow path 51 is supplied to the pressure chambers 36 via the reservoir 44 and the ink supply path 37. Then, the head unit 15 is configured such that a pressure change is generated in the ink inside the pressure chambers 36 by the piezoelectric element 30 being driven and the ink is ejected from the nozzle 38 by using the pressure change.

Next, the fixing member 16 will be described.

Figure 6:
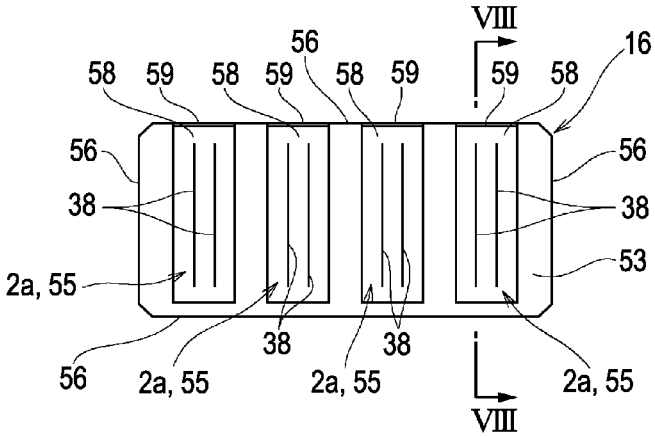
FIG. 6 is a bottom view of a fixing member in a state where a nozzle is exposed to an exposure opening section.
Figure 7:
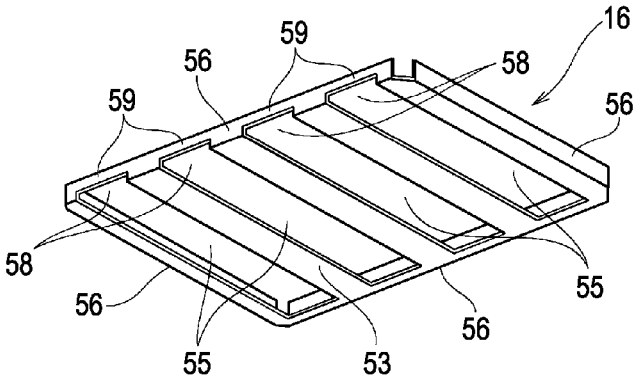
FIG. 7 is a perspective view of the fixing member.
Figure 8:
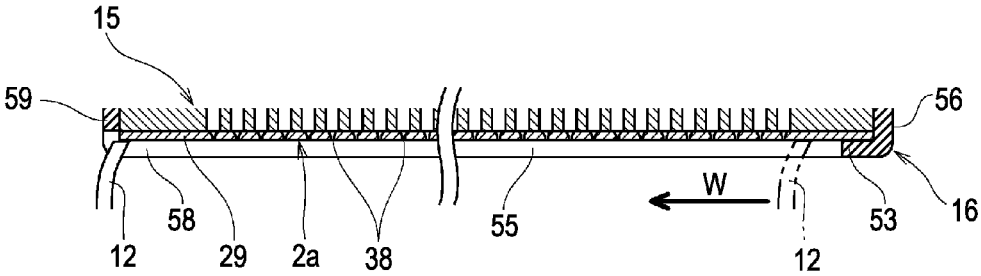
FIG. 8 is a cross-sectional view of a main portion which is taken along line VIII-VIII in FIG. 6.

FIG. 6 is a bottom view of the fixing member 16 in a state where the nozzle 38 is exposed, FIG. 7 is a perspective view of the fixing member 16 and the FIG. 8 is a cross-sectional view of a main portion which is taken along line VIII-VIII in FIG. 6.

The fixing member 16 is a member to which a plurality of (four in the embodiment) head units 15 are fixed and which positions a relative position between the head units 15, and is formed by bending a metal material (in particular, a stainless steel plate). When describing specifically, as illustrated in FIGS. 6 and 7, the fixing member 16 has a rectangular fixing plate section 53 of which the lower surface faces the recording paper 5 and the upper surface of the fixing plate section 53 is joined to the nozzle forming surface 2*a* as the fixing reference surface of the head unit 15 using the adhesive 54 (see, FIGS. 4 and 5). In addition, a plurality (four in the embodiment) of exposure opening sections 55, which expose the nozzle forming surface 2*a* joined to the fixing reference surface, are opened on the fixing plate section 53 in a state of being aligned along the arrangement direction (in other words, the main scanning direction) of the head unit 15. In addition, each of the exposure opening sections 55 has a rectangular opening section which passes through the fixing plate section 53 in the thickness direction thereof and is long along the direction of the nozzle row, and is set to a size capable of exposing the entire nozzle rows which are formed on at least the nozzle forming surface 2*a* (see, FIG. 6). In addition, a side wall section 56, which is bent to the upper holder 14 side, is molded at the peripheral edge of the fixing plate section 53. The side wall section 56 and the side surface of the head unit 15 are joined together using the adhesive 54. Furthermore, a ground electrode of a circuit substrate (not illustrated), a sheet metal and the like which are connected to the ground electrode of the circuit substrate is connected to the side wall section 56 and the fixing member 16 is conducted (grounded) to the ground (see, FIGS. 4 and 5). Accordingly, the static electricity entering from the nozzle forming surface 2*a* is caused to escape to the ground and then the circuit or the like mounted on the flexible cable 41 can be protected.

Then, as illustrated in FIGS. 7 and 8, a cutout section 58 is formed downstream (left side in FIG. 8) in the wiping direction W of the wiping member 12 in the exposure opening sections 55 by cutting out the fixing plate section 53 and the side wall section 56 which is positioned downstream in the wiping direction W. The exposure opening sections 55 is opened in the wiping direction W by the cutout section 58 and the edge portion of the nozzle forming surface 2*a* is exposed from the cutout section 58. In addition, portions of the fixing member 16 which are positioned both sides of the cutout section 58 are bent to the opposite side (the upper side) in the liquid ejection direction (the direction facing the recording paper 5 side). A connection section 59, which is an upper edge portion of the side wall section 56, connects the bending sections to each other. Furthermore, the connection section 59 is positioned on the holder 14 side which is upper than the nozzle forming surface 2*a* and is joined to the side surface of the head unit 15 using the adhesive 54.

In the recording head 2 including the fixing member 16 which has the configuration described above, a stepped portion (specifically, a stepped portion upwards in the wiping direction W), which appears at the edge of the opening of the exposure opening sections 55 due to the plate thickness of the fixing plate section 53, is not present downstream in the wiping direction W of the wiping member 12 in the exposure opening sections 55. Accordingly, the wiping member 12 can smoothly pass through the edge of the nozzle forming surface 2*a* without the edge portion of the nozzle forming surface 2*a* exposed from the cutout section 58 being caught and can wipe the ink out from the nozzle forming surface 2*a*, after the wiping member 12 moves in the wiping direction W in a state where the upper end portion thereof comes into contact with the nozzle forming surface 2*a* and then wipes the nozzle forming surface 2*a*. Thus, the ink is easily wiped from the nozzle forming surface 2*a* even though the viscosity of the ink is thicker than that of the related art. Accordingly, the drawback such as the accumulated ink on the nozzle forming surface 2*a* can be suppressed.

Furthermore, even though the cutout section 58 is provided, the fixing member 16 is unlikely to be deformed since the bending portions positioned on the both sides of the cutout section 58 are connected to each other by the connection section 59. Accordingly, the head unit 15 can be fixed to a position as designed. In addition, the fixing member 16 is formed of a metal plate material and the cutout section 58 is formed by cutting out the fixing plate section 53 which is positioned downstream in the wiping direction W, and thereby the fixing member 16 in which the cutout section 58 is formed can be easily produced.

Meanwhile, in the embodiment described above, the fixing member produced by bending the metal plate material or the like is exemplified, however, the invention is not limited to the embodiment. For example, a synthetic resin fixing member, which is injection molded in a state where the exposure opening section and the cutout section are opened, may be applied to the recording head (the liquid ejecting head). Furthermore, in the embodiment described above, as the pressure generation unit, so-called a flexible vibration type piezoelectric element is exemplified, however, the invention is not limited to the embodiment. For example, the invention may employ so-called a vertical vibration type piezoelectric element. In addition, the invention may be applied to a configuration which employs a pressure generation unit such as a heating element which generates a pressure change using heated air bubbles or an electrostatic actuator which generates the pressure change by displacing an operation surface of a pressure chamber using the electrostatic force.

Further, the invention is not limited to the printer and may be applied to all types of ink jet type recording apparatus such as a plotter, a facsimile machine, a copier, or a liquid ejecting apparatus other than the recording apparatus, for example, a display manufacturing apparatus, an electrode manufacturing apparatus and a chip manufacturing apparatus, if the liquid ejecting head includes the head unit of which the nozzle forming surface is wiped by the wiping member along the arrangement direction of the nozzle row, and the fixing member which is molded by a plate material and fixes the head unit, and if the liquid ejecting apparatus includes the liquid ejecting head and the wiping member.

The entire disclosure of Japanese Patent Application No. 2012-034742, filed Feb. 21, 2012 is incorporated by reference herein.

What is claimed is:

1. A liquid ejecting head comprising:

a head unit having a nozzle forming surface on which a plurality of rows of nozzles ejecting a liquid are arranged and of which the nozzle forming surface is wiped by a wiping member along an arrangement direction of the nozzle rows; and a fixing member fixing the head unit, wherein the fixing member has a fixing plate section on which an exposure opening section exposing the nozzles of the nozzle forming surface is formed and of which an upper surface is joined to the nozzle forming surface as a fixing reference surface in a state where the nozzle is exposed into the exposure opening section, and wherein a cutout section, which opens the exposure opening section in the wiping direction and exposes an edge portion of the nozzle forming surface, is formed downstream of the wiping member in the wiping direction in the exposure opening section.

2. The liquid ejecting head according to claim 1, wherein the fixing member is formed by a metal plate material and the cutout section is formed by cutting the fixing plate section positioned downstream in the wiping direction.

3. A liquid ejecting apparatus comprising the liquid ejecting head and the wiping member according to claim 2.

4. The liquid ejecting head according to claim 1, wherein portions of the fixing member which are positioned at both sides of the cutout section are bent to the opposite side in the liquid ejecting direction and the bent portions are connected to each other by a connection section.

5. A liquid ejecting apparatus comprising the liquid ejecting head and the wiping member according to claim 4.

6. A liquid ejecting apparatus comprising the liquid ejecting head and the wiping member according to claim 1.

* * * * *